United States Patent [19]

Breslin

[11] 4,295,928

[45] Oct. 20, 1981

[54] PHENOLIC COMPOUNDS AS VISCOSITY PRESERVATIVES DURING HYPOCHLORITE PULP BLEACHING

[75] Inventor: Michael D. Breslin, Downers Grove, Ill.

[73] Assignee: Nalco Chemical Company, Oak Brook, Ill.

[21] Appl. No.: 176,229

[22] Filed: Aug. 7, 1980

[51] Int. Cl.[3] ..... D21C 9/14

[52] U.S. Cl. ..... 162/73; 162/72; 162/87; 162/77

[58] Field of Search ..... 162/72, 73, 87, 77; 8/108 A; 252/187 H

[56] References Cited

U.S. PATENT DOCUMENTS 4,096,029 6/1978 Mills ..... 162/87

4,213,821 7/1980 Vanderhoek et al. ..... 162/72

FOREIGN PATENT DOCUMENTS 6201 1/1980 European Pat. Off. ..... 162/72

OTHER PUBLICATIONS

TAPPI, vol. 34, No. 5, May 1951, pp. 209–215.

*Primary Examiner*—William F. Smith

*Attorney, Agent, or Firm*—John G. Premo; Robert A. Miller

[57] ABSTRACT

Improved pulp strength and brightness of chemically produced pulp can be obtained by treating the pulp with the addition of 0.05–0.5% based on the weight of the dry fiber of certain aromatic materials in the hypochlorite bleaching stage.

5 Claims, No Drawings

PHENOLIC COMPOUNDS AS VISCOSITY PRESERVATIVES DURING HYPOCHLORITE PULP BLEACHING

This invention relates to a process for the delignification and bleaching of cellulosic pulp produced by a chemical pulping process. Typically, processes of this type are conducted utilizing chemicals that while increasing the brightness of the resulting pulp stock, cause fiber degradation and, hence, a loss of pulp strength. It has been discovered, however, that through the use of certain phenolic compounds as additives, fiber strength can be preserved in hypochlorite bleaching processes.

The object of delignification and bleaching of cellulosic pulp is to produce pulp with high brightness, good brightness stability, and maximum pulp strength at minimum cost and with minimum environmental pollution. Unfortunately, however, achievement of or improvement in one of the above factors is often attained only at the expense of another of the important factors.

In an effort to achieve a suitable balance between the competing factors, bleach plants have resorted to multistage processes. A typical bleach plant pulp treatment comprises: (a) chlorination (C) of the pulp under acid conditions; (b) alkaline extraction (E) of the chlorinated lignin derivative from the pulp with aqueous sodium hydroxide; (c) oxidation (i.e. bleaching) with sodium or calcium hypochlorite (H) under alkaline conditions; (d) a second sodium hydroxide extraction (E); and, (e) a final bleach with chlorine dioxide (D).

Such a sequence is labeled CEHED and is commonly used for delignification and bleaching of kraft (i.e. sulfate) pulp. Similar sequences with fewer stages, such as CEH or CEHD are commonly used for sulfite pulp which generally contains less lignin and color bodies than does sulfate pulp. Many other such sequences have been proposed and used in the industry's continuing efforts to achieve a suitable balance of the competing factors for the various pulps, pulping processes, and end-use physical property requirements.

Regardless of the sequence used, the bulk of cellulose bleaching still is performed using some combination of chlorination (C) alkaline extraction (E), and hypochlorite bleaching (H) stages. The chlorination stage converts most of the colored lignin that remains after the initial pulping or digestion process to chlorinated lignin derivatives which are partially soluble in acidic chlorine solution and particularly soluble in alkaline extraction liquors. Such a stage is also referred to as the delignification stage. Although the net effect of such a stage (after alkaline extraction) is generally a darkening of the cellulosic pulp attributable to increased color development in the residual lignin material, a major amount of the lignin is removed in the chlorination-extraction sequence, facilitating efficient bleaching reactions in the later oxidation stages.

An extraction stage generally follows chlorination. Such a stage serves to remove the chlorinated lignin derivatives from the cellulose substrate, thus exposing for subsequent treatment the lignin material which was unaffected by the chlorination stage by virtue of the topochemical nature of the reaction. H. W. Gierts "Developments in Bleaching Processes," TAPPI, May 1951, Volume 34, No. 5.

Hypochlorite treatments conducted under alkaline conditions and chlorine dioxide treatments conducted at an acidic pH value, are primarily characterized by destructive oxidation of residual colored lignin to colorless degradation products. Such a stage is, therefore, primarily a bleaching stage although some minor amount of chlorination followed by extraction of the alkaline or acidic bleaching liquors may occur simultaneously.

Of the competition between important factors, the tradeoff between brightness and pulp strength (often measured as pulp viscosity) has been of particular concern to the paper industry and has been primarily responsible for the proliferation of the various bleaching sequences. Such a tradeoff apparently results from a nonselective oxidation reaction. By the term "nonselective," it is meant that the oxidative action is not limited to lignin oxidation, but instead also involves destructive oxidation of the cellulosic material, thus reducing the length of the cellulose molecules and, accordingly, reducing the strength and viscosity of the pulp. The exact extent of such cellulose oxidation depends upon reaction conditions such as temperature, pH, reaction time, and chlorine concentration, and upon the nature of the pulp being treated. For example, the brightness-strength tradeoff in delignification and bleaching is less pronounced for sulfite pulp than it is for sulfate pulp since less severe treatment is required for sulfite pulp than it is for sulfate pulp since less severe treatment is required for sulfite pulp than for sulfate pulp to achieve equivalent brightness characteristics.

In either case, that is, for sulfite or sulfate-produced pulps, fiber degradation occurs during the delignification and bleaching steps. While physical parameters such as the concentration of bleaching agent, temperature, and time can be optimized for a given system, pulp degradation invariably occurs. As such, it would be a benefit to the art if a method could be obtained for maintaining pulp strength of chemically produced cellulosic pulp during the hypochlorite bleaching stage.

It is therefore an object of this invention to provide to the art a process for limiting fiber degradation during the hypochlorite bleaching stage of pulp processing.

A further object of this invention is to provide to the art an improved process for the delignification and bleaching of chemically produced cellulosic pulp which encompasses maintaining in the aqueous slurry of the pulp during the hypochlorite bleaching stage from 0.05–0.50 weight percent based upon the dry weight of the fiber of certain aromatic phenol compounds.

THE INVENTION

The present invention is applicable to all liquid phase acidic chlorination processes for the delignification of wood pulp produced by chemical pulping processes. While chlorination is the general method employed industrially for the delignification of pulps of this type, bromine or other halogens can also be employed (see for example U.S. Pat. No. 4,096,029 which is hereby incorporated by reference). It will be readily seen that this invention also applies to those processes. The aromatic materials which are useful as viscosity preservation aids in hypochlorite bleaching according to this invention are generally phenolic compounds. These materials include phenol, thymol, hydroquinone, 8-hydroxyquinoline, 1,2,dihydroxy substituted anthraquinone, and 2, 6, disulfonic acid substituted anthroquinone (sodium salt). Preferred additives to the hypochlorite bleaching stage of this invention include thymol and hydroquinone.

The materials useful in the practice of the invention are added to the hypochlorite bleaching stage at a level of from 0.01–0.05% by weight, based upon the dry weight of the pulp. Preferably the additives of this invention are added at a level of from 0.015–0.15% and preferably from 0.02–0.1%, based upon the dry weight of the pulp.

When used in accordance with this invention the additives as described and claimed act to limit cellulose degradation occurring during the hypochlorite bleaching stage. While not directly increasing brightness, the additives of this invention do not hinder or help brightness, but do result in a paper having increased strength.

In order to demonstrate the utility of this invention the following examples are presented.

Experimental Procedure

Pulp that had previously undergone commercial chlorination and extraction stage treatments was utilized to ensure a constant baseline pulp characteristic. The post extraction (E) stage pulp was thoroughly washed with fresh water, thickened in a laundry type centrifuge, and homogenized in a Hobart mixer to ensure uniform moisture. The consistency of the post E pulp was 30±2% and was checked before each experiment by determining the moisture loss at 105° C.

The hypochlorite bleaching was conducted in plastic sealable bags that were placed in a constant temperature bath controlled to ±1° F.

The bleaching bags were prepared by weighing the equivalent of 20 grams dry pulp from the post E stock into a heat sealable plastic bag. Bleaching liquor was prepared by adding 10–15 g/l sodium hypochlorite (as $Cl_2$), diluted from commercial 5.25% household bleach, 25 g/l NaOH, and phenolic compound treatments prepared in 10 g/l solutions; to a sufficient volume of fresh water so the consistency of the pulp in the bag would be 10%. After the addition of the bleaching liquor, the bags were sealed, and the contents mixed thoroughly by massaging the bags for one minute before placing them in a constant temperature bath. After the allotted time in the bath, the bags were cut open and a sufficient amount of spent bleaching liquor filtered through a stainless steel 100 mesh screen and collected for pH and residual hypochlorite analysis. The bleached pulp was washed with several aliquots of fresh water totaling 1 liter. The pulp was then available for further bleaching stages or to make handsheets for pulp viscosity and GE brightness analysis.

EXAMPLE 1

A sample of commercial post E softwood pulp having a pulp viscosity of 27.5 cps, permanganate number of 3.8, and 33 GE brightness was bleached with 2.5% sodium hypochlorite based on dry pulp as previously described for 60 minutes at 110° F. The control hypo bleached pulp was degraded to a pulp viscosity of 8.6 cps with a 77.0 GE brightness. With no caustic buffer added to the bleaching bag, the final pH of the bleaching liquor was 7.3. The bleaching liquor had a pH over 12.0 at the start, but the caustic is consumed during bleaching as HCl and organic acids are formed.

EXAMPLE 2

The same commercial pulp used in Example 1 was bleached under the same conditions as above with the addition of one of several phenolic compounds to demonstrate the ability of these compounds to preserve pulp viscosity. The results of this work, including the use of additives listed in this invention, are found in Table I.

EXAMPLE 3

Thymol and hydroquinone were screened at a level of 0.1% of the dry weight of the pulp as per TAPPI procedure T230. The pulp viscosity of the hypochlorite-bleached wood pulp treated with the additives was 10–30% higher than control samples. Table II gives an example of viscosity preservation possible by this invention.

TABLE I

| No. | Treatment | Dosage Level | pH | Viscosity | GEB |
|---|---|---|---|---|---|
| 1 | Control (E stage) | — | — | 27.5 | 33.4 |
| 2 | Control (Hypo) | — | 7.3 | 8.6 | 77.0 |
| 3 | Hydroquinone | 0.1% | 7.2 | 12.35 | 75.9 |
| 4 | 1, 2 dihydroxy substituted anthraquinone | 0.1% | 6.9 | 9.7 | 75.6 |
| 5 | 8-hydroxyquinoline | 0.1% | 6.7 | 10.2 | 76.6 |

TABLE II

| Treatment | Post CE Viscosity | Control Hypo Viscosity | Treated Hypo Viscosity | % Preservation |
|---|---|---|---|---|
| 0.1% Thymol | 30 cps | 9.0 cps | 14.3 cps | 25 |
| 0.1% Hydroquinone | 30 cps | 8.0 cps | 12.4 cps | 20 |

We claim:

1. In a method for the bleaching of aqueous slurries of chemically produced cellulosic materials utilizing a hypochlorite bleaching agent selected from the group consisting of sodium hypochlorite and calcium hypochlorite, the improvement comprising maintaining in the aqueous slurry of the chemically produced cellulosic material during treatment with said bleaching agent from 0.01–0.5% by weight of an aromatic compound selected from the group consisting of: thymol and hydroquinone.

2. The method of claim 1 wherein the bleaching agent is sodium hypochlorite.

3. The method of claim 1 wherein said aromatic compound is hydroquinone.

4. The method of claim 1 wherein the aromatic compound is thymol.

5. The method of claim 1 wherein the aromatic compound is added at a level of from 0.02–0.1% based upon the dry weight of the pulp.

* * * * *